US008117959B2

(12) United States Patent
Wakita et al.

(10) Patent No.: US 8,117,959 B2
(45) Date of Patent: Feb. 21, 2012

(54) SWASH PLATE TYPE COMPRESSOR

(75) Inventors: Tomohiro Wakita, Kariya (JP); Mitsuyo Ishikawa, Kariya (JP); Jun Kondo, Kariya (JP); Takeshi Aoki, Kariya (JP); Shinichi Sato, Kariya (JP); Shinsuke Asou, Kariya (JP); Masashi Oda, Kariya (JP); Kazushige Murao, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 970 days.

(21) Appl. No.: 11/694,696

(22) Filed: Mar. 30, 2007

(65) Prior Publication Data

US 2007/0292279 A1 Dec. 20, 2007

(30) Foreign Application Priority Data

Mar. 31, 2006 (JP) ..... 2006-100812

(51) Int. Cl.
*F04B 1/12* (2006.01)

(52) U.S. Cl. ..... 91/503; 91/499; 91/502; 417/269

(58) Field of Classification Search ..... 91/502, 91/503; 417/269
See application file for complete search history.

(56) References Cited

U.S. PATENT DOCUMENTS

| | | | | |
|---|---|---|---|---|
| 4,746,275 | A | 5/1988 | Iwamori et al. | 417/269 |
| 5,362,208 | A * | 11/1994 | Inagaki et al. | 417/269 |
| 5,401,144 | A | 3/1995 | Fujii et al. | 417/269 |
| 5,694,828 | A | 12/1997 | Umemura et al. | 92/71 |
| 5,738,000 | A | 4/1998 | Forster | |
| 6,368,073 | B1 | 4/2002 | Kanai et al. | |

FOREIGN PATENT DOCUMENTS

| | | |
|---|---|---|
| JP | 05-306680 | 11/1993 |
| JP | 05-312146 | 11/1993 |
| JP | 07-027048 | 1/1995 |
| JP | 08-135569 | 5/1996 |
| JP | 10-089245 | 4/1998 |

* cited by examiner

*Primary Examiner* — Devon C Kramer
*Assistant Examiner* — Philip Stimpert
(74) *Attorney, Agent, or Firm* — Woodcock Washburn LLP

(57) ABSTRACT

A swash plate includes a boss, which is mounted on the drive shaft, and a plate portion, which extends from the boss to be inclined with respect to the drive shaft. A rotary valve includes a suction passage, which sequentially connects cylinder bores in a suction stroke via an associated guide passage. An introduction guide communicates with the shaft bore to introduce the refrigerant gas in the swash plate chamber to the rotary valve. The introduction guide faces the boss and extends in the radial direction from the shaft bore beyond the boss. Therefore, suction efficiency of refrigerant gas from the swash plate chamber to the cylinder bore has improved.

9 Claims, 6 Drawing Sheets

SWASH PLATE TYPE COMPRESSOR

BACKGROUND OF THE INVENTION

The present invention relates to a swash plate type compressor, which is equipped with a rotary valve for connecting a cylinder bore that is in a suction stroke to a swash plate chamber.

Japanese Laid-Open Patent Publication No. 5-306680 discloses a swash plate type variable displacement compressor equipped with a rotary valve. The rotary valve is mounted on the circumferential surface of a drive shaft. The outer circumferential surface of the rotary valve includes a variable suction passage. The rotary valve is accommodated in a shaft bore of a cylinder block such that the rotary valve rotates with respect to the cylinder block and moves in the axial direction of the drive shaft. The surface of the cylinder block facing the swash plate chamber includes an inlet groove for drawing in refrigerant gas from the swash plate chamber. The inlet groove communicates with the shaft bore. The cylinder block has cut-out grooves, which connect the shaft bore to the cylinder bores. When any of the cylinder bores is in a suction stroke, refrigerant gas in the swash plate chamber is drawn into the cylinder bore via the inlet groove, the shaft bore, the variable suction passage, and the associated cut-out groove.

In the compressor of the above publication, the inlet groove is open toward a boss of a swash plate, which rotates integrally with the drive shaft. The distance between the boss and the inlet groove is always constant even when the swash plate is rotating. Therefore, during operation of the compressor, rotation of the boss generates stationary vortices in refrigerant between the boss and the inlet groove, which hinders refrigerant gas from being drawn into the inlet groove. As a result, the amount of refrigerant gas drawn into the cylinder bore is suppressed.

SUMMARY OF THE INVENTION

Accordingly, it is an objective of the present invention to provide a swash plate type compressor that has improved suction efficiency of refrigerant gas from a swash plate chamber to a cylinder bore.

According to one aspect of the invention, a swash plate type compressor is provided. The compressor includes a housing, which defines a swash plate chamber inside the housing. The swash plate chamber contains refrigerant gas. A drive shaft is rotatably supported by the housing. The drive shaft defines an axial direction and a radial direction. A cylinder block is included in the housing. The cylinder block has a shaft bore, through which the drive shaft extends. A plurality of cylinder bores are arranged about the shaft bore at intervals from one another. A plurality of guide passages each connects the associated cylinder bore to the shaft bore. A plurality of pistons each is disposed in the corresponding cylinder bore. A swash plate is accommodated in the swash plate chamber. The swash plate includes a boss, which is mounted on the drive shaft, and a plate portion, which extends from the circumferential surface of the boss to be inclined with respect to the drive shaft. The plate portion is coupled to the pistons. The swash plate rotates integrally with the drive shaft causing each piston to reciprocate in the corresponding cylinder bore. A rotary valve rotates in synchronization with the drive shaft. The rotary valve includes a suction passage, which sequentially connects the cylinder bores in a suction stroke via the associated guide passage. An introduction guide communicates with the shaft bore to introduce the refrigerant gas in the swash plate chamber to the rotary valve. The introduction guide faces the boss and extends in the radial direction from the shaft bore beyond the boss.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

Figure 1:
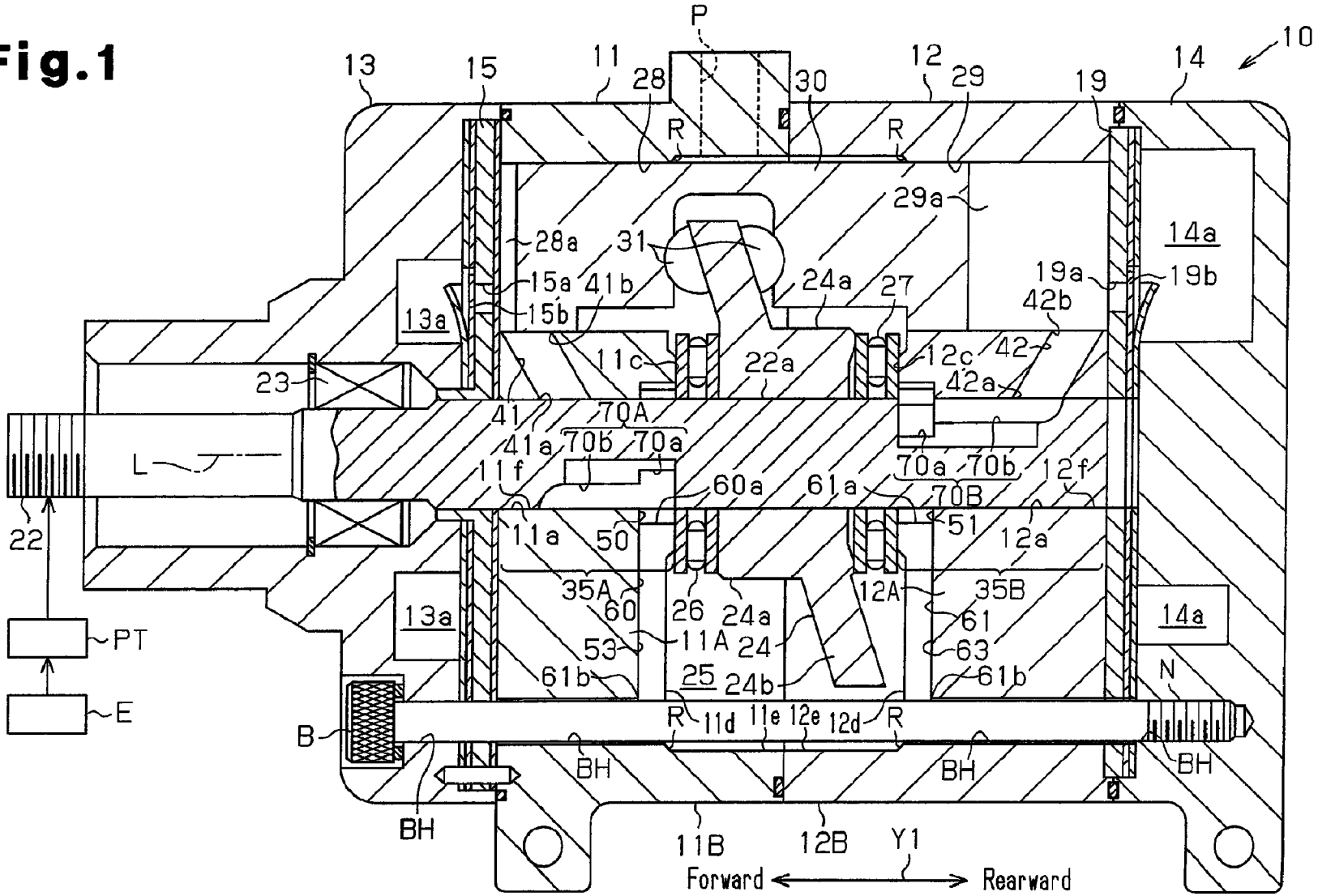
FIG. 1 is a longitudinal cross-sectional view illustrating a double-headed piston swash plate type compressor according to a first embodiment of the present invention.

A first embodiment of the present invention will now be described with reference to FIGS. 1 to 5. FIG. 1 shows a swash plate type compressor 10 according to the first embodiment. The compressor 10 is a double-headed piston swash plate type compressor. Arrow Y1 of FIG. 1 represents the front and rear direction of the compressor 10. The front and rear direction is parallel to the direction of an axis L, that is, the axial direction of the compressor 10.

As shown in FIG. 1, a housing of the compressor 10 includes, in order from the left to the right in FIG. 1, a front housing member 13, a front cylinder block 11, a rear cylinder block 12, and a rear housing member 14, which are coupled to one another. The front housing member 13 and the rear housing member 14 are components of the housing. A front valve plate assembly 15 is located between the front cylinder block 11 and the front housing member 13. A rear valve plate assembly 19 is located between the rear cylinder block 12 and the rear housing member 14.

Several, for example, five through bolts B tightly secure the front cylinder block 11, the rear cylinder block 12, the front housing member 13, and the rear housing member 14. The front cylinder block 11, the rear cylinder block 12, the front housing member 13, and the rear housing member 14 have several, for example, five bolt holes BH, which extend in the axial direction. The five bolt holes BH are located at equal angular intervals in the circumferential direction. Each through bolt B is inserted in the corresponding one of the bolt holes BH. A threaded portion N is formed at the distal end of each through bolt B to be screwed to the rear housing member 14. The diameter of the bolt holes BH is greater than that of the through bolts B. FIG. 1 shows one of the bolt holes BH and one of the through bolts B.

The front cylinder block 11 includes a columnar front block body 11A and a front circumferential wall 11B, which extends from the periphery of the front block body 11A. The rear cylinder block 12 includes a columnar rear block body 12A and a rear circumferential wall 12B, which extends from the periphery of the rear block body 12A. The bolt holes BH are adjacent to the circumferential walls 11B, 12B.

The front block body 11A has the front opposing surface 11*d*, which faces the rear block body 12A. The rear block body 12A has the rear opposing surface 12*d*, which faces the front opposing surface 11*d*. The front circumferential wall 11B has a front inner circumferential surface 11*e*. The rear circumferential wall 12B has a rear inner circumferential surface 12*e*. The front circumferential wall 11B is joined to the rear circumferential wall 12B. The opposing surfaces 11*d*, 12*d* and the inner circumferential surfaces 11*e*, 12*e* define a swash plate chamber 25.

Figure 5:
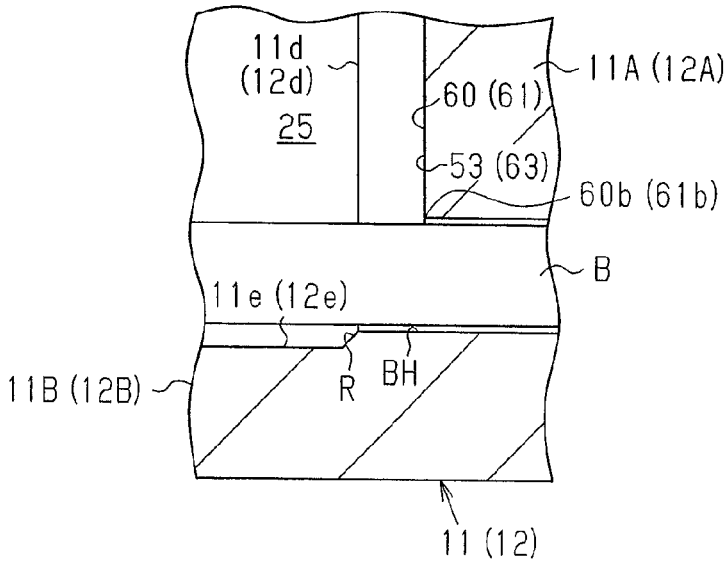
FIG. 5 is a partially enlarged view of FIG. 1 illustrating bolt holes and suction recesses.

As shown in FIGS. 1 and 5, a front inclined surface R is formed between a front opposing surface 11*d* and the front circumferential wall 11B. The front inclined surface R is also located between the circumferential surface of the bolt holes BH and the front circumferential wall 11B. The front inclined surface R faces the swash plate chamber 25. The front inclined surface R prevents the front opposing surface 11*d* from intersecting the front circumferential wall 11B at a right angle. That is, the front inclined surface R makes the angle between the front opposing surface 11*d* and the front circumferential wall 11B gentle.

A rear inclined surface R is formed between a rear opposing surface 12*d* and the rear circumferential wall 12B. The rear inclined surface R is also located between the circumferential surface of the bolt holes BH and the rear circumferential wall 12B. The rear inclined surface R faces the swash plate chamber 25. The rear inclined surface R prevents the rear opposing surface 12*d* from intersecting the rear circumferential wall 12B at a right angle. The rear inclined surface R makes the angle between the rear opposing surface 12*d* and the rear circumferential wall 12B gentle.

At the center portion of the front block body 11A is formed a through hole, which is a front shaft bore 11*a* in the first embodiment. At the center portion of the rear block body 12A is formed a through hole, which is a rear shaft bore 12*a* in the first embodiment. The drive shaft 22 extends through the shaft bores 11*a*, 12*a*. The inner circumferential surface of the front shaft bore 11*a* functions as a front slide bearing 11*f*. The inner circumferential surface of the rear shaft bore 12*a* functions as a rear slide bearing 12*f*. The slide bearings 11*f*, 12*f* rotatably support the drive shaft 22. The through bolts B and the bolt holes BH extend through the swash plate chamber 25.

Between the front housing member 13 and the drive shaft 22 is located a lip seal 23. The drive shaft 22 protrudes outside the compressor 10. A power transmission mechanism PT located outside the compressor 10 selectively connects the drive shaft 22 to a drive source of the vehicle, which is an internal combustion engine E.

The swash plate chamber 25 accommodates a swash plate 24. The swash plate 24 is mounted on the drive shaft 22 to rotate integrally with the drive shaft 22. The swash plate 24 has a disk-like plate portion 24*b* and a cylindrical boss 24*a*, which protrudes from the plate portion 24*b*. The drive shaft 22 is fitted to a through hole of the boss 24*a*. That is, the boss 24*a* permits the plate portion 24*b* to be attached to the circumferential surface of the drive shaft 22. In other words, the plate portion 24*b* extends from the circumferential surface of the boss 24*a*. The plate portion 24*b* is integrated with the boss 24*a*. The plate portion 24*b* is inclined with respect to the drive shaft 22. Several, for example, five double-headed pistons 30 are coupled to the periphery of the plate portion 24*b*. A pair of hemispherical shoes 31 are located between each double-headed piston 30 and the plate portion 24*b*.

A front thrust bearing 26 is arranged between the front block body 11A and the boss 24*a*. The front block body 11A has a front seat 11*c*, which receives the front thrust bearing 26. The front seat 11*c* is formed to have an annular shape to surround the front shaft bore 11*a* and faces the boss 24*a*.

A rear thrust bearing 27 is arranged between the rear block body 12A and the boss 24*a*. The rear block body 12A has a rear seat 12*c*, which receives the rear thrust bearing 27. The rear seat 12*c* is formed to have an annular shape to surround the rear shaft bore 12*a* and faces the boss 24*a*. The thrust bearings 26, 27 receive thrust load that acts on the double-headed pistons 30 and the swash plate 24. The thrust bearings 26, 27, which sandwich the swash plate 24, restrict the drive shaft 22 from moving in the direction of the axis L.

Figure 2:
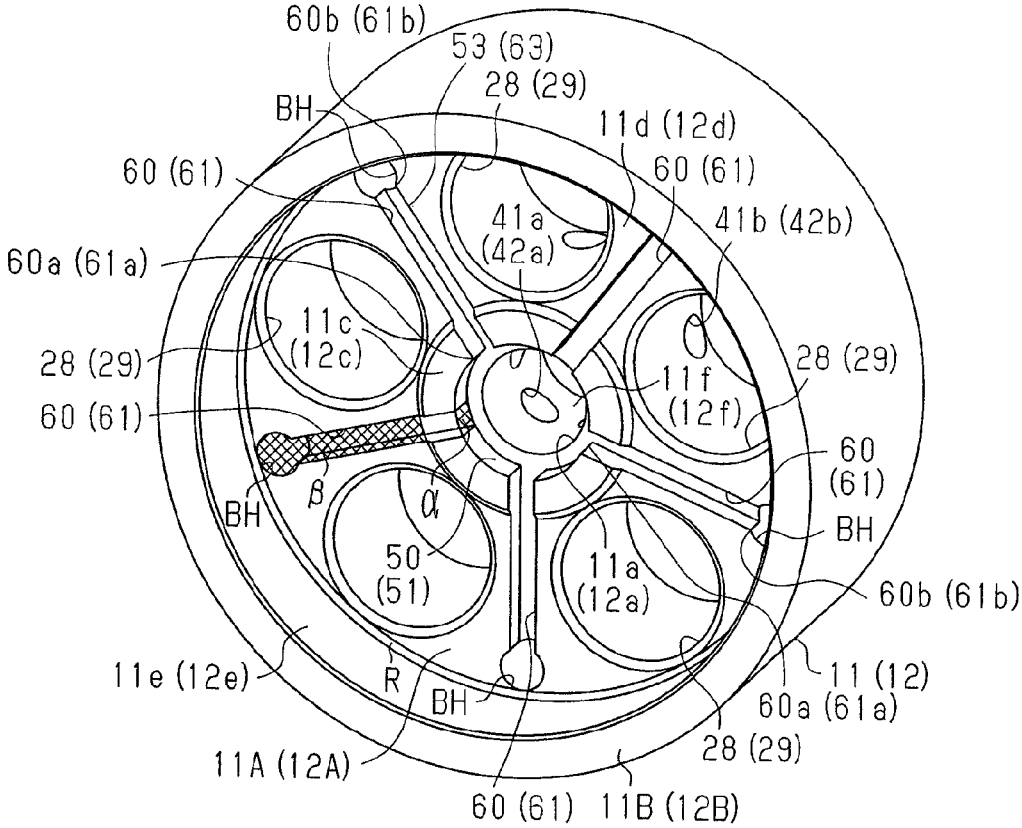
FIG. 2 is a perspective view illustrating the cylinder block shown in FIG. 1.

As shown in FIG. 2, the front block body 11A has several, for example, five front cylinder bores 28. The five front cylinder bores 28 are arranged about the drive shaft 22. The rear block body 12A has several, for example, five rear cylinder bores 29. The five rear cylinder bores 29 are arranged about the drive shaft 22. Each of the front cylinder bores 28 faces the associated rear cylinder bore 29. The five bolt holes BH and the five front cylinder bores 28 are arranged alternately one by one in the circumferential direction. That is, the five bolt holes BH and the five rear cylinder bores 29 are arranged alternately one by one in the circumferential direction.

The front block body 11A has several, for example, five front guide passages 41, which extend in the radial direction. Each front guide passage 41 connects the corresponding front cylinder bore 28 to the front shaft bore 11*a*. Each front guide passage 41 has a front inlet 41*a*, which opens in the circumferential surface of the front shaft bore 11*a*, and a front outlet 41*b*, which opens in the circumferential surface of the front cylinder bore 28.

The rear block body 12A has several, for example, five rear guide passages 42, which extend in the radial direction. Each of the rear guide passages 42 connects the corresponding rear cylinder bore 29 to the rear shaft bore 12*a*. Each rear guide passage 42 has a rear inlet 42*a*, which opens in the circumferential surface of the rear shaft bore 12*a*, and a rear outlet 42*b*, which opens in the circumferential surface of the rear cylinder bore 29.

The compressor 10 has five double-headed pistons 30. A pair of one of the front cylinder bores 28 and the associated rear cylinder bore 29 accommodates one of the double-headed pistons 30. As the drive shaft 22 rotates, the swash plate 24 is rotated, which causes the double-headed piston 30 to reciprocate in the associated cylinder bores 28, 29. The front valve plate assembly 15 closes the front openings of the front cylinder bores 28, and the double-headed pistons 30 close the rear openings of the front cylinder bores 28. As a result, a front compression chamber 28*a* is defined in each front cylinder bore 28. The volume of each front compression chamber 28*a* changes in accordance with reciprocation of the associated double-headed piston 30. The double-headed pistons 30 close the front openings of the rear cylinder bores 29. The rear valve plate assembly 19 closes the rear openings of the rear cylinder bores 29. As a result, a rear compression chamber 29*a* is defined in each rear cylinder bore 29. The volume of each rear compression chamber 29*a* changes in accordance with reciprocation of the associated double-headed piston 30.

A discharge pressure zone, which is a front discharge chamber 13*a* in the first embodiment, is formed in the front housing member 13. Discharge ports 15*a*, which correspond to the front compression chambers 28*a*, and front discharge valve flaps 15*b*, which selectively open and close the discharge ports 15*a*, are formed in the front valve plate assembly 15.

A discharge pressure zone, which is a rear discharge chamber 14*a* in the first embodiment, is formed in the rear housing member 14. Discharge ports 19*a*, which correspond to the rear compression chambers 29*a*, and rear discharge valve flaps 19*b*, which selectively open and close the discharge ports 19*a*, are formed in the rear valve plate assembly 19.

The front circumferential wall 11B has a suction port P, which connects the swash plate chamber 25 to the outside of the compressor 10. The front housing member 13 has a front outlet (not shown), which selectively connects the front discharge chamber 13*a* to the outside of the compressor 10. The rear housing member 14 has a rear outlet (not shown), which selectively connects the rear discharge chamber 14*a* to the outside of the compressor 10.

The suction port P is connected to an external refrigerant circuit (not shown). The external refrigerant circuit includes a gas cooler, an expansion valve, and an evaporator. The suction port P is connected to an outlet of the evaporator. The discharge chambers 13*a*, 14*a* are connected to inlets of the gas cooler. The compressor 10 introduces refrigerant gas of the evaporator to the swash plate chamber 25 via the suction port P. The compression chambers 28*a*, 29*a*draw in refrigerant gas from the swash plate chamber 25, compress the refrigerant gas, and discharge the compressed refrigerant gas to the discharge chambers 13*a*, 14*a*.

Next, a refrigerant gas suction system of the compressor 10 will now be described.

Figure 4:
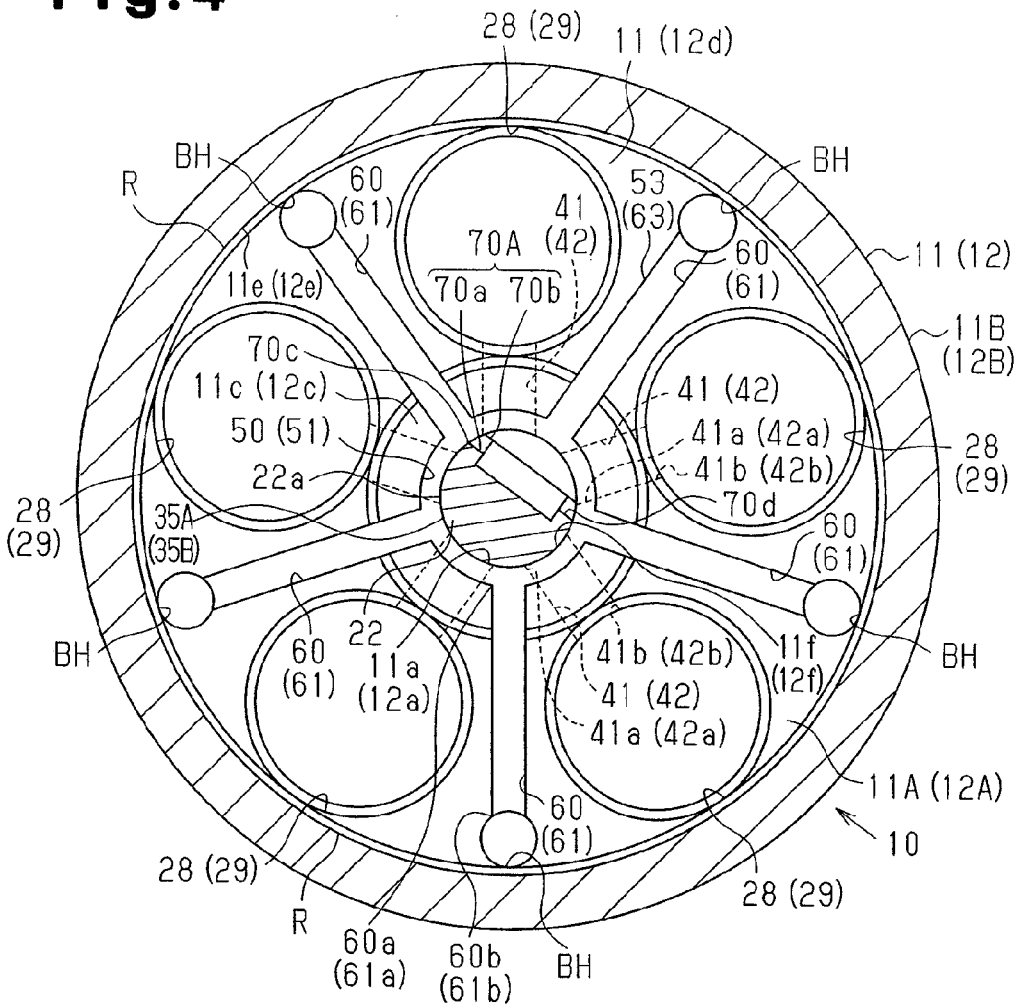
FIG. 4 is a transverse cross-sectional view illustrating an assembled state of the cylinder block of FIG. 2 and the drive shaft of FIG. 3.

As shown in FIGS. 1 and 4, the drive shaft 22 has a front rotary valve 35A corresponding to the front block body 11A and a rear rotary valve 35B corresponding to the rear block body 12A. In other words, the rotary valves 35A, 35B are formed integrally with the drive shaft 22, and rotate in synchronization with the drive shaft 22. The front rotary valve 35A permits the front cylinder bores 28 to sequentially draw in refrigerant gas from the swash plate chamber 25. The rear rotary valve 35B permits the rear cylinder bores 29 to sequentially draw in refrigerant gas from the swash plate chamber 25. In other words, parts of a circumferential surface 22*a* of the drive shaft 22 that face the slide bearings 11*f*, 12*f* function as the rotary valves 35A, 35B.

As shown in FIGS. 1, 2 and 4, the front block body 11A has a front introduction guide 53 facing the swash plate chamber 25. The front introduction guide 53 introduces refrigerant gas in the swash plate chamber 25 to the front rotary valve 35A. The front introduction guide 53 is formed in the front opposing surface 11*d*.

The rear block body 12A has a rear introduction guide 63 facing the swash-plate chamber 25. The rear introduction guide 63 introduces refrigerant gas in the swash plate chamber 25 to the rear rotary valve 35B. The rear introduction guide 63 is formed in the rear opposing surface 12*d*.

The front introduction guide 53 includes a front annular groove 50, several front suction recesses 60, and part of the bolt holes BH. The front annular groove 50 and the front suction recesses 60 are formed in the front opposing surface 11*d*. The front annular groove 50 surrounds the front shaft bore 11*a* and the front rotary valve 35A. In this embodiment, five front suction recesses 60 extend in the radial direction from the front annular groove 50.

Each front suction recess 60 includes an inner end 60*a*, which communicates with the front annular groove 50, and an outer end 60*b*, which communicates with the associated bolt hole BH. That is, the outer ends 60*b* of the front suction recesses 60 are opening ends located at radially outer end of the front opposing surface 11*d*. In other words, part of the bolt holes BH configure part of the front introduction guide 53 so as to be connected to the front suction recesses 60 to function together as the front introduction guide 53. The front suction recesses 60 are narrow grooves, which extend in the radial direction of the drive shaft 22. The front suction recesses 60 are arranged at equal angular intervals in the circumferential direction of the drive shaft 22. The five front suction recesses 60 and the five front cylinder bores 28 are arranged alternately one by one in the circumferential direction. That is, each front suction recess 60 is arranged between an adjacent pair of the front cylinder bores 28.

The rear introduction guide 63 includes a rear annular groove 51, several rear suction recesses 61, and part of the bolt holes BH. The rear annular groove 51 and the rear suction recesses 61 are formed in the rear opposing surface 12*d*. The rear annular groove 51 surrounds the rear shaft bore 12*a* and the rear rotary valve 35B. In this embodiment, five rear suction recesses 61 extend in the radial direction of the rear annular groove 51.

Each rear suction recess 61 includes an inner end 61*a*, which communicates with the rear annular groove 51, and an outer end 61*b*, which communicates with the associated bolt hole BH. That is, the outer ends 61*b* of the rear suction recesses 61 are opening ends located at radially outer end of the rear opposing surface 12*d*. In other words, part of the bolt holes BH configure part of the rear introduction guide 63 so as to be connected to the rear suction recesses 61 to function together as the rear introduction guide 63. The rear suction recesses 61 are narrow grooves, which extend in the radial direction of the drive shaft 22. The rear suction recesses 61 are arranged at equal angular intervals in the circumferential direction of the drive shaft 22. The five rear suction recesses 61 and the five rear cylinder bores 29 are arranged alternately one by one in the circumferential direction. That is, each rear suction recess 61 is arranged between an adjacent pair of the rear cylinder bores 29.

The suction recesses 60, 61 extend radially outward from the annular grooves 50, 51 over the seats 11*c*, 12*c* to the circumferential walls 11B, 12B. That is, the suction recesses 60, 61 extend radially outward than the boss 24*a*. The outer ends 60*b*, 61*b* of the suction recesses 60, 61 are not covered by the boss 24*a*, and faces the plate portion 24*b*. That is, the outer ends 60*b*, 61*b* are freely open to the swash plate chamber 25. As described above, the thrust bearings 26, 27 and the boss 24*a* do not cover the entire suction recesses 60, 61.

FIG. 2 shows the cross-sectional area $\alpha$ of the suction recesses 60, 61 and the opening area $\beta$ of the suction recesses 60, 61 with two kinds of shades. The cross-sectional area $\alpha$ represents the cross-sectional area of the suction recesses 60, 61 along a plane perpendicular to the radial direction. The opening area $\beta$ represents the opening area of part of the suction recesses 60, 61 that is radially outward of the seats 11*c*, 12*c* along a plane perpendicular to the axial direction. That is, the opening area $\beta$ shows the opening area of part of the suction recesses 60, 61 that face the plate portion 24*b*. In other words, the opening area $\beta$ represents the area of the suction recesses 60, 61 that does not face the boss 24*a* and is open to the swash plate chamber 25. The opening area β is greater than the cross-sectional area α.

Figure 3:
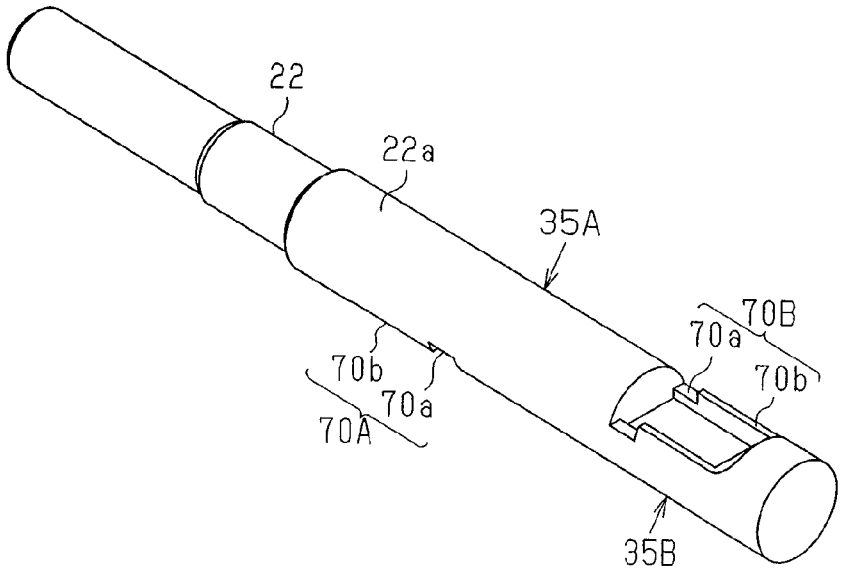
FIG. 3 is a perspective view illustrating the drive shaft and the suction passage of the compressor shown in FIG. 1.

As shown in FIGS. 1 and 3, the circumferential surface 22*a* of the drive shaft 22 has a front suction passage 70A, which corresponds to the front rotary valve 35A, and a rear suction passage 70B, which corresponds to the rear rotary valve 35B. The front suction passage 70A and the rear suction passage 70B are located at intervals of 180 degrees in the circumferential direction of the drive shaft 22. The front suction passage 70A corresponds to the front shaft bore 11*a*. The rear suction passage 70B corresponds to the rear shaft bore 12*a*. Refrigerant gas in the swash plate chamber 25 is drawn into the front cylinder bores 28 via the front introduction guide 53, the front suction passage 70A, and the front guide passages 41. Refrigerant gas in the swash plate chamber 25 is drawn into the rear cylinder bores 29 via the rear introduction guide 63, the rear suction passage 70B, and the rear guide passages 42.

The suction passages 70A, 70B are defined by grooves formed in the circumferential surface 22*a* of the drive shaft 22. The suction passages 70A, 70B are formed in the shape of steps. That is, each suction passage 70A, 70B includes a first communication section 70*a* and a second communication section 70*b*. Both of the first communication sections 70*a* are located between the both of the second communication sections 70*b* in the axial direction. The dimension of the first communication section 70*a* in the circumferential direction is greater than that of the second communication section 70*b*. That is, the cut-out depth of the drive shaft 22 at the suction passages 70A, 70B changes stepwise.

The first communication sections 70*a* correspond to the introduction guides 53, 63. The second communication sections 70*b* correspond to the guide passages 41, 42. That is, the first communication section 70*a* of the front rotary valve 35A constantly communicates with the five front suction recesses 60 via the front annular groove 50. During operation of the compressor 10, the second communication section 70*b* of the front rotary valve 35A constantly connects the first communication section 70*a* to at least one of the front guide passages 41. That is, one of the front cylinder bores 28 constantly draws in refrigerant gas from the swash plate chamber 25 via the front rotary valve 35A and the five front suction recesses 60.

The first communication section 70*a* of the rear rotary valve 35B constantly communicates with the five rear suction recesses 61 via the rear annular groove 51. During operation of the compressor 10, the second communication section 70*b* of the rear rotary valve 35B constantly connects the first communication section 70*a* to at least one of the rear guide passages 42. That is, one of the rear cylinder bores 29 constantly draws in refrigerant gas from the swash plate chamber 25 via the rear rotary valve 35B and the five rear suction recesses 61.

As shown in FIG. 4, the first communication section 70*a* has a first circumferential end 70*c*, which is the end in the circumferential direction, and a second circumferential end 70*d*, which is opposite to the first circumferential end 70*c*. When the first circumferential end 70*c* of the front rotary valve 35A faces the inner end 60*a* of one of the front suction recesses 60, the second circumferential end 70*d* faces the inner end 60*a* of the front suction recess 60 that is spaced from the first one with another suction recess 60 in between. More specifically, when the first circumferential end 70*c* faces half of the cross-sectional area α of one of the suction recesses 60, the second circumferential end 70*d* faces half of the cross-sectional area α of the suction recess 60 that is spaced from the first one with another suction recess 60 in between. In other words, one suction recess 60 exists between the suction recess 60 that faces the first circumferential end 70*c* and the suction recess 60 that faces the second circumferential end 70*d*. In this manner, during operation of the compressor 10, the first communication section 70*a* constantly face at least two suction recesses 60.

As shown in FIG. 4, during operation of the compressor 10, the second communication section 70*b* of the front rotary valve 35A communicates with at least one of the front guide passages 41. That is, the second communication section 70*b* of the front rotary valve 35A sequentially communicates with the front inlets 41*a* of the five front guide passages 41 intermittently. During operation of the compressor 10, there are times during which the second communication section 70*b* of the front rotary valve 35A simultaneously communicates with the front inlets 41*a* of two of the front guide passages 41. Therefore, the circumferential surface 22*a* of the drive shaft 22 selectively blocks the front guide passages 41. In the same way, the second communication section 70*b* of the rear rotary valve 35B communicates with at least one of the rear guide passages 42.

The operations of the compressor 10 will now be described.

In the case where one of the front cylinder bores 28 shown in FIG. 1 is in a suction stroke, that is, when one of the double-headed pistons 30 shown in FIG. 1 moves from the left to the right in FIG. 1, the second communication section 70*b* of the front rotary valve 35A is connected to the front inlet 41*a* of one of the front guide passages 41 shown in FIG. 1. Refrigerant gas in the swash plate chamber 25 is drawn into one of the front cylinder bores 28 shown in FIG. 1 via the five front suction recesses 60, the front annular groove 50, the first communication section 70*a* and the second communication section 70*b* of the front rotary valve 35A, and the associated front guide passage 41 shown in FIG. 1.

When one of the rear cylinder bores 29 shown in FIG. 1 is in a suction stroke, that is, when one of the double-headed pistons 30 moves from the right to the left of FIG. 1, the second communication section 70*b* of the rear rotary valve 35B is connected to the rear inlet 42*a* of one of the rear guide passages 42 shown in FIG. 1. Refrigerant gas in the swash plate chamber 25 is drawn into one of the rear cylinder bores 29 shown in FIG. 1 via the five rear suction recesses 61, the rear annular groove 51, the first communication section 70*a* and the second communication section 70*b* of the rear rotary valve 35B, and the associated rear guide passage 42 shown in FIG. 1.

When one of the front cylinder bores 28 shown in FIG. 1 is in a discharge stroke, that is, when one of the double-headed pistons 30 moves from the right to the left in FIG. 1, the circumferential surface 22*a* of the front rotary valve 35A disconnects the front cylinder bore 28 shown in FIG. 1 from the swash plate chamber 25. Refrigerant gas in the associated front compression chamber 28*a* passes through the corresponding front discharge port 15*a*, presses open the associated front discharge valve flap 15*b*, and is discharged to the front discharge chamber 13*a*. Refrigerant gas in the front discharge chamber 13*a* flows out to the external refrigerant circuit.

When one of the rear cylinder bores 29 shown in FIG. 1 is in a discharge stroke, that is, when one of the double-headed pistons 30 shown in FIG. 1 moves from the left to the right in FIG. 1, the circumferential surface 22*a* of the rear rotary valve 35B disconnects the rear cylinder bore 29 shown in FIG. 1 from the swash plate chamber 25. Refrigerant gas in the associated rear compression chamber 29*a* passes through the corresponding rear discharge port 19*a*, presses open the associated rear discharge valve flap 19*b*, and is discharged to the rear discharge chamber 14*a*. Refrigerant gas in the rear discharge chamber 14*a* flows out to the external refrigerant circuit.

The outer ends 60*b*, 61*b* of the suction recesses 60, 61 are located radially outward of the boss 24*a*. The outer ends 60*b*, 61*b* are directly open to the swash plate chamber 25. The outer ends 60*b*, 61*b* face the plate portion 24*b*.

When the swash plate 24 is rotating, the distance between the plate portion 24*b* and the suction recesses 60, 61 continuously changes. That is, the plate portion 24*b* constantly stirs refrigerant gas in the vicinity of the suction recesses 60, 61. As a result, stationary vortices are prevented from being generated between the plate portion 24*b* and the suction recesses 60, 61. Thus, the suction recesses 60, 61 are prevented from being affected by vortices in refrigerant gas, and promptly draw in refrigerant gas from the swash plate chamber 25.

Refrigerant gas includes lubricant for lubricating various sliding portions of the compressor 10. The lubricant is separated from refrigerant gas and thrown to the periphery of the swash plate chamber 25 by centrifugal force caused by rotation of the drive shaft 22 and the swash plate 24, and adheres to the circumferential walls 11B, 12B of the swash plate chamber 25 and the through bolts B. As refrigerant gas in the swash plate chamber 25 is drawn into the suction recesses 60, 61, the lubricant on the circumferential walls 11B, 12B is transferred along the inclined surfaces R and flows into the bolt holes BH and the suction recesses 60, 61. The lubricant on the through bolts B moves along the through bolts B, and subsequently flows into the suction recesses 60, 61. The lubricant that has flowed into the suction recesses 60, 61 is drawn into the cylinder bores 28, 29 via the annular grooves 50, 51, the suction passages 70A, 70B, and the guide passages 41, 42. In this manner, the lubricant circulates within the compressor 10.

The first embodiment has the following advantages.

(1) The opposing surfaces 11*d*, 12*d* of the cylinder blocks 11, 12 facing the swash plate chamber 25 have the suction recesses 60, 61. The suction recesses 60, 61 introduce refrigerant gas in the swash plate chamber 25 to the front and rear rotary valves 35A, 35B. The outer ends 60*b*, 61*b* of the suction recesses 60, 61 are located radially outward than the boss 24*a* of the swash plate 24. That is, the suction recesses 60, 61 face the boss 24*a* and extend in the radial direction from the shaft bores 11*a*, 12*a* beyond the boss 24*a*. The outer ends 60*b*, 61*b* are not disconnected by the swash plate 24, and are open to the swash plate chamber 25. Therefore, the outer ends 60*b*, 61*b* of the suction recesses 60, 61 easily draw in refrigerant gas from the swash plate chamber 25 without being affected by rotation of the swash plate 24.

Thus, the front and rear rotary valves 35A, 35B draw in refrigerant gas from the swash plate chamber 25 without being inhibited by the swash plate 24. In other words, the boss 24*a* does not inhibit the flow of refrigerant gas into the cylinder bores 28, 29. Therefore, for example, as compared to a case where the outer ends 60*b*, 61*b* of the suction recesses 60, 61 face the boss 24*a*, the suction efficiency of refrigerant gas drawn into the cylinder bores 28, 29 is improved. This improves the compression efficiency of the compressor 10.

(2) The cylinder blocks 11, 12 have the annular grooves 50, 51 located between the suction recesses 60, 61 and the front and rear rotary valves 35A, 35B. Refrigerant gas in the suction recesses 60, 61 is stored in the annular grooves 50, 51. Thus, the cylinder bores 28, 29 in the suction stroke draw in refrigerant gas from the suction recesses 60, 61 via the annular grooves 50, 51. Therefore, the cylinder bores 28, 29 easily draw in sufficient amount of refrigerant gas.

(3) The opening area β of the suction recesses 60, 61 is greater than the cross-sectional area α of the suction recesses 60, 61. For example, when the opening area β is smaller than the cross-sectional area α, the suction recesses 60, 61 undesirably serve as restrictors restricting the flow of refrigerant gas. That is, the smaller opening area β makes it difficult to ensure the sufficient amount of refrigerant gas drawn into the suction recesses 60, 61 from the swash plate chamber 25. That is, the sufficient amount of refrigerant gas is not introduced to the front and rear rotary valves 35A, 35B. Only securing the cross-sectional area α does not eliminate such disadvantage.

According to the first embodiment, a large amount of refrigerant gas in the suction recesses 60, 61 is easily and efficiently introduced to the front and rear rotary valves 35A, 35B. That is, a large amount of refrigerant gas is easily and efficiently drawn into the cylinder bores 28, 29.

(4) The outer ends 60*b*, 61*b* of the suction recesses 60, 61 do not face the boss 24*a*, and are directly open to the swash plate chamber 25. Therefore, the outer ends 60*b*, 61*b* easily draw in refrigerant gas and lubricant without being affected by rotation of the swash plate 24. That is, the boss 24*a* does not inhibit introduction of lubricant to the suction recesses 60, 61. Thus, lubricant easily flows into the front and rear rotary valves 35A, 35B, the guide passages 41, 42, and the cylinder bores 28, 29. Therefore, sliding performance of the drive shaft 22 and the front and rear rotary valves 35A, 35B with respect to the cylinder blocks 11, 12 is improved. This also improves the sliding performance of the double-headed pistons 30.

(5) The inclined surfaces R are formed between the circumferential walls 11B, 12B and the bolt holes BH. The lubricant on the circumferential walls 11B, 12B easily flows into the suction recesses 60, 61 via the inclined surfaces R. The lubricant that has flowed into the suction recesses 60, 61 circulates within the compressor 10 with the flow of refrigerant gas. Therefore, the sliding portions of the compressor 10 are easily lubricated.

In particular, in the first embodiment, the circumferential surface of the bearings 11*f*, 12*f* function as the slide bearings 11*f*, 12*f*, which rotatably support the drive shaft 22. That is, the cylinder blocks 11, 12 do not include additional radial bearings, and directly support the drive shaft 22 and the front and rear rotary valves 35A, 35B. Therefore, the inclined surfaces R, which easily circulate the lubricant are suitable for lubricating the slide bearings 11*f*, 12*f*.

The density of the lubricant adhered to the circumferential walls 11B, 12B is relatively high in the compressor 10. The inclined surfaces R are advantageous for introducing the high-density lubricant into the suction recesses 60, 61. Therefore, the sliding performance of the drive shaft 22 and the front and rear rotary valves 35A, 35B is easily improved.

(6) The outer ends 60*b*, 61*b* of the suction recesses 60, 61 communicate with the bolt holes BH. That is, part of the bolt holes BH function as part of the introduction guides 53, 63. Therefore, for example, as compared to a case where the suction recesses 60, 61 are formed adjacent to the circumferential walls 11B, 12B and do not communicate with the bolt holes BH, the first embodiment suppresses decrease in the strength of the cylinder blocks 11, 12.

The lubricant included in the refrigerant gas is separated from the refrigerant gas by centrifugal force, and adheres to the circumferential walls 11B, 12B or the through bolts B. The lubricant adhered to the through bolts B is transferred along the through bolts B, and is subsequently drawn into the suction recesses 60, 61. Since the bolt holes BH of the first embodiment communicate with the suction recesses 60, 61, lubricant on the through bolts B is easily drawn into the suction recesses 60, 61. Therefore, as compared to a case where, for example, the suction recesses 60, 61 are separate from the bolt holes BH, the first embodiment easily ensures an adequate amount of lubricant introduced to the suction recesses 60, 61. That is, an adequate amount of lubricant introduced to the cylinder bores 28, 29 is easily ensured.

(7) Each of the cylinder blocks 11, 12 has several, that is, five suction recesses 60, 61. Therefore, as compared to a case where, for example, each of the cylinder blocks 11, 12 has a single suction recess 60, 61, an adequate amount of refrigerant gas drawn into the front and rear rotary valves 35A, 35B is easily ensured.

(8) The suction recesses 60, 61 and the cylinder bores 28, 29 are arranged alternately one by one in the circumferential direction. Thus, the suction recesses 60, 61 are arranged in a well-balanced manner at equal intervals in the entire circumferential direction of the swash plate chamber 25. This prevents, for example, the suction recesses 60, 61 from being arranged unevenly. The front and rear rotary valves 35A, 35B of the first embodiment efficiently draw in refrigerant gas from the swash plate chamber 25.

(9) The front and rear rotary valves 35A, 35B are formed integrally with the drive shaft 22. That is, the suction passages 70A, 70B are directly formed in the circumferential surface 22*a* of the drive shaft 22. Thus, as compared to a case where, for example, separate rotary valves are mounted on the drive shaft 22, the first embodiment reduces the number of components of the compressor 10. Furthermore, the first embodiment prevents enlargement of the shaft bores 11*a*, 12*a*, which accommodate the front and rear rotary valves 35A, 35B. That is, enlargement of the compressor 10 is suppressed.

(10) The front housing member 13 and the rear housing member 14 of the first embodiment eliminate a suction chamber of refrigerant gas. Instead, the swash plate chamber 25 serves as the suction chamber. Therefore, the first embodiment suppresses increase in the axial dimension of the compressor 10.

(11) The drive shaft 22 is a solid body and does not have an internal passage. The suction passages 70A, 70B of the front and rear rotary valves 35A, 35B are formed in the circumferential surface 22*a* of the drive shaft 22. This improves the rigidity of the drive shaft 22.

(12) The front and rear rotary valves 35A, 35B draw in refrigerant gas from the swash plate chamber 25, which is located between the front cylinder block 11 and the rear cylinder block 12, and transfer the refrigerant gas to the associated cylinder bores 28, 29. Therefore, unlike a compressor that, for example, defines a suction chamber only between the rear housing member 14 and the rear valve plate assembly 19 so as to transfer refrigerant gas in the suction chamber to the front cylinder bores 28, the compressor of the first embodiment easily draws in refrigerant gas to the cylinder bores 28, 29 evenly.

(13) As shown in FIG. 4, the first communication section 70*a* of the front rotary valve 35A constantly faces the inner end 60*a* of at least one of the suction recesses 60 when the front rotary valve 35A is at any rotational position. Likewise, the first communication section 70*a* of the rear rotary valve 35B constantly faces the inner end 61*a* of at least one of the suction recesses 61 when the rear rotary valve 35B is at any rotational position. Thus, the suction passages 70A, 70B easily draw in refrigerant gas from the suction recesses 60, 61. Therefore, refrigerant gas is promptly and efficiently drawn into the cylinder bores 28, 29.

(14) The suction passages 70A, 70B each include the first communication section 70*a*, which faces the corresponding one of the annular grooves 50, 51, and the second communication section 70*b*, which faces the guide passages 41, 42. The dimension of the first communication section 70*a* in the circumferential direction is greater than that of the second communication section 70*b*. Thus, the opening area of the suction passages 70A, 70B with respect to the suction recesses 60, 61 is easily increased. That is, refrigerant gas is easily drawn into the suction passages 70A, 70B. Therefore, refrigerant gas is easily drawn into the cylinder bores 28, 29.

Next, a second embodiment of the present invention will be described with reference to FIG. 6. In a compressor 80 according to the second embodiment, the same members as the first embodiment are given the same numbers and detailed explanations are omitted. Arrow Y2 in FIG. 6 represents the front and rear direction of the compressor 80.

Figure 6:
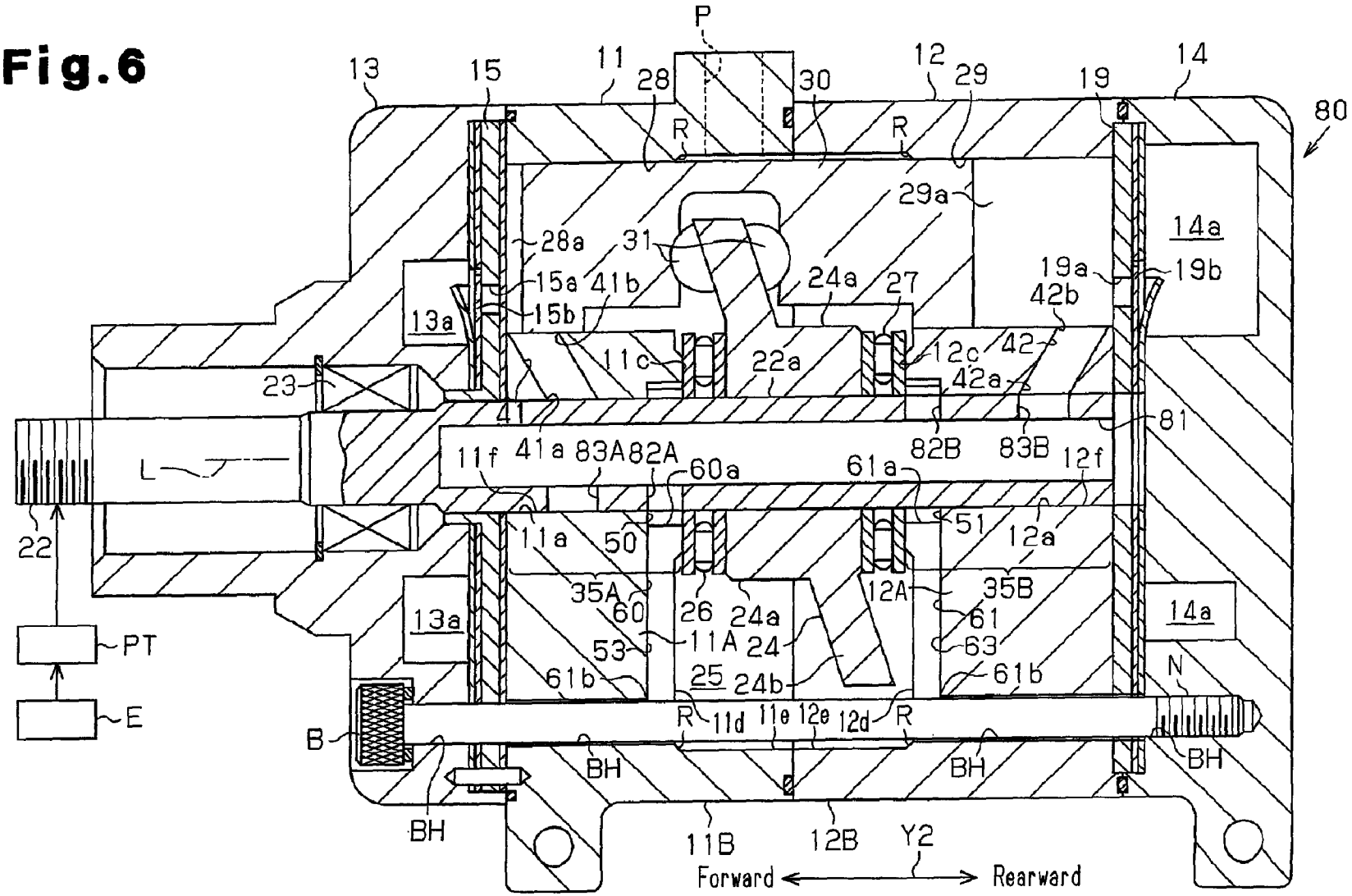
FIG. 6 is a longitudinal cross-sectional view illustrating a compressor according to a second embodiment of the present invention.

As shown in FIG. 6, the drive shaft 22 of the second embodiment is a hollow body and has an internal passage extending in the axial direction. The internal passage is a supply passage 81 in the second embodiment. The drive shaft 22 has a front introduction hole 82A, which connects the supply passage 81 to the front annular groove 50, and a rear introduction hole 82B, which connects the supply passage 81 to the rear annular groove 51.

The drive shaft 22 has a front outlet hole 83A, which connects the supply passage 81 to the front inlets 41*a* of the front guide passages 41, and a rear outlet hole 83B, which connects the supply passage 81 to the rear inlets 42*a* of the rear guide passages 42. Refrigerant gas in the swash plate chamber 25 is introduced into the cylinder bores 28, 29 via the suction recesses 60, 61, the annular grooves 50, 51, the introduction holes 82A, 82B, the supply passage 81, the outlet holes 83A, 83B, and the guide passages 41, 42. The supply passage 81, the introduction holes 82A, 82B, and the outlet holes 83A, 83B configure a suction passage, which connects the suction recesses 60, 61 to the guide passages 41, 42. The front rotary valve 35A of the second embodiment includes the front introduction hole 82A and the front outlet hole 83A. The rear rotary valve 35B includes the rear introduction hole 82B and the rear outlet hole 83B. The front introduction hole 82A and the rear introduction hole 82B are located at an interval of 180° in the circumferential direction of the drive shaft 22. The front outlet hole 83A and the rear outlet hole 83B are located at an interval of 180° in the circumferential direction of the drive shaft 22.

When one of the front cylinder bores 28 is in a suction stroke, refrigerant gas in the swash plate chamber 25 is drawn into the front cylinder bore 28 via the front suction recesses 60, the front annular groove 50, the front introduction hole 82A, the supply passage 81, the front outlet hole 83A, and the associated front guide passage 41.

When one of the rear cylinder bores 29 is in a suction stroke, refrigerant gas in the swash plate chamber 25 is drawn into the rear cylinder bore 29 via the rear suction recesses 61, the rear annular groove 51, the rear introduction hole 82B, the supply passage 81, the rear outlet hole 83B, and the associated rear guide passage 42.

The above embodiments may be modified as follows.

The rotary valves 35A, 35B need not be formed integrally with the drive shaft 22. Rotary valves 35A, 35B that are separate from the drive shaft 22 may be mounted on the drive shaft 22.

The suction recesses 60, 61 and the cylinder bores 28, 29 need not be arranged alternately one by one in the circumferential direction. For example, the suction recesses 60, 61 may be arranged two by two in the circumferential direction.

The number of the suction recesses 60, 61 is not limited to five, but may be one, two, three, or four.

Six cylinder bores 28, 29 and six suction recesses 60, 61 may be arranged alternately one by one.

The length of the suction recesses 60, 61 may be adjusted such that the suction recesses 60, 61 are separate from the bolt holes BH.

The cross-sectional area α of the suction recesses 60, 61 may be the same as the opening area β of the suction recesses 60, 61.

The length of the suction recesses 60, 61 may be changed as long as the outer ends 60*b*, 61*b* of the suction recesses 60, 61 are located radially outward than the boss 24*a*.

Figure 7:
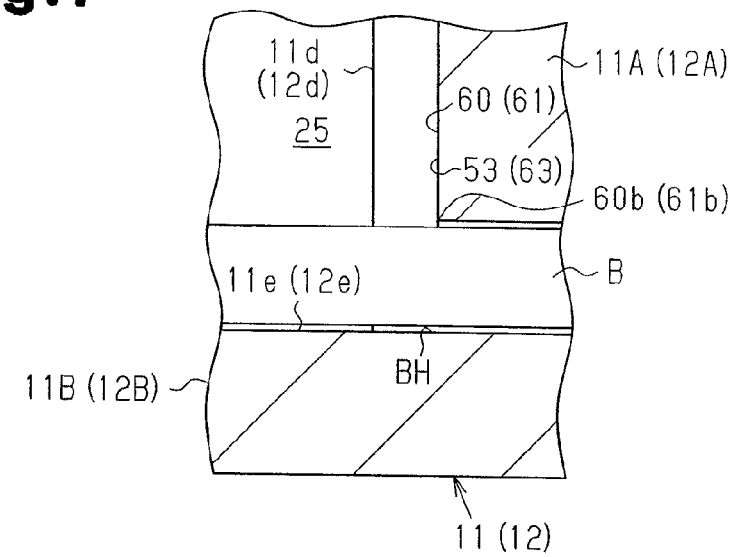
FIG. 7 is a partially enlarged view of a bolt hole and a suction recess according to a modified embodiment of the present invention.

As shown in FIG. 7, the circumferential surfaces of the bolt holes BH may be flush with the inner circumferential surfaces lie, 12*e* of the circumferential walls 11B, 12B. In this case, lubricant adhered to the inner circumferential surfaces 11*e*, 12*e* easily flows into the bolt holes BH without being disturbed by a step. Thus, lubricant is easily introduced to the cylinder bores 28, 29.

Figure 8:
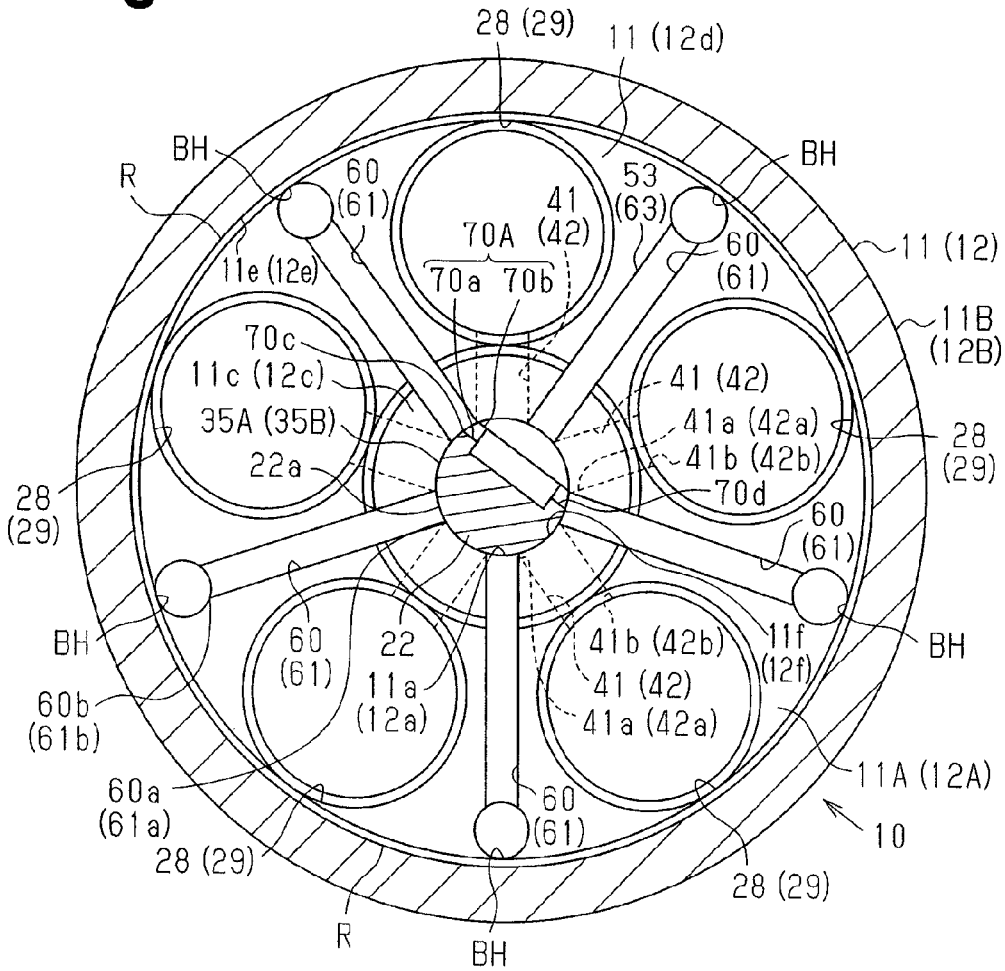
FIG. 8 is a transverse cross-sectional view illustrating an assembled state of a cylinder block and a drive shaft according to another modified embodiment.

As shown in FIG. 8, the annular grooves 50, 51 may be omitted. That is, only the suction recesses 60, 61 may configure the introduction guide. In this case, the suction recesses 60, 61 are directly connected to the shaft bore 11*a*, 12*a*. In this case also, the first communication section 70*a* of the front rotary valve 35A constantly faces the inner end 60*a* of at least one of the suction recesses 60, and the first communication section 70*a* of the rear rotary valve 35B constantly faces the inner end 61*a* of at least one of the suction recesses 61. Therefore, the suction passages 70A, 70B easily ensure an adequate suction amount of refrigerant gas from the suction recesses 60, 61.

Figure 9:
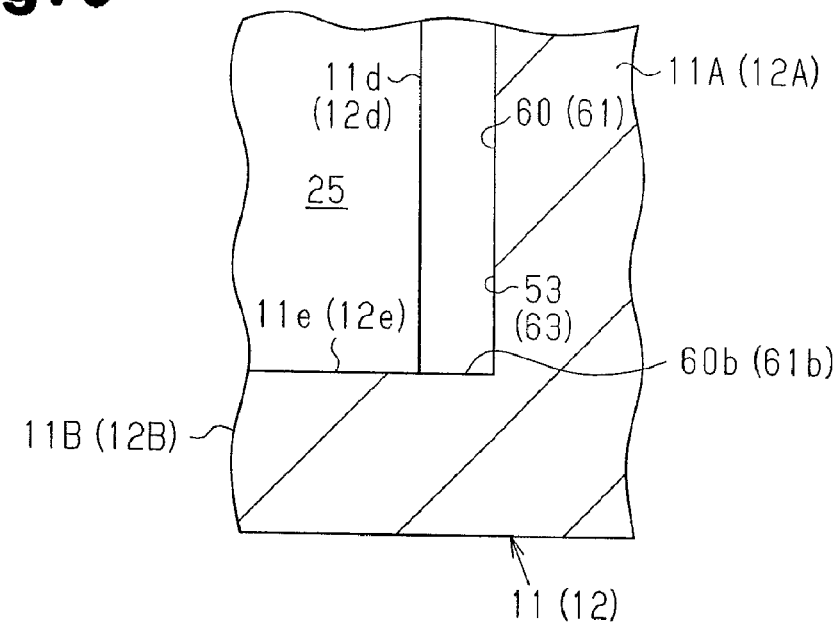
FIG. 9 is a partially enlarged view of a bolt hole and a suction recess according to another modified embodiment.

As shown in FIG. 9, the outer ends 60*b*, 61*b* of the suction recesses 60, 61 may extend to the inner circumferential surfaces 11*e*, 12*e* of the circumferential walls 11B, 12B in a state separate from the bolt holes BH.

Figure 10:
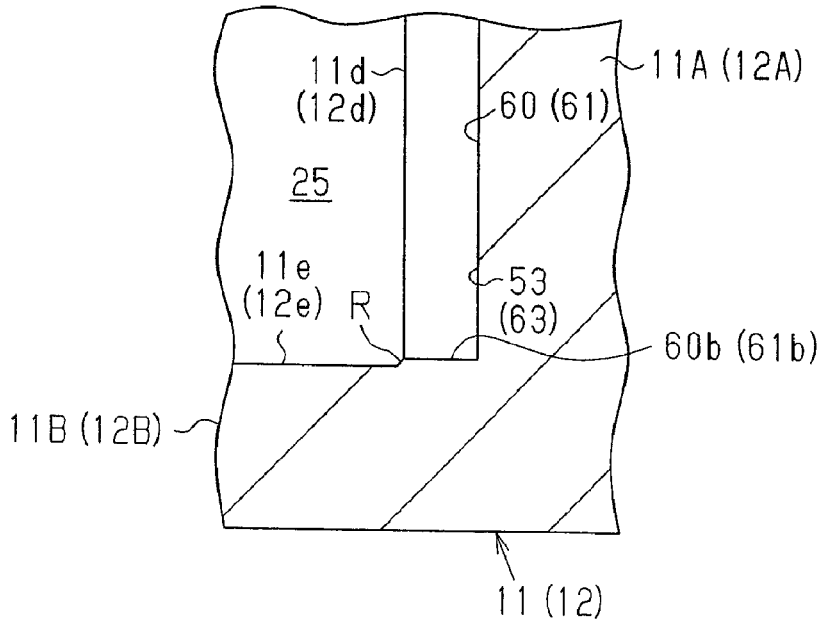
FIG. 10 is a partially enlarged view of a bolt hole and a suction recess according to another modified embodiment.

As shown in FIG. 10, the inclined surfaces R may be defined between the suction recesses 60, 61 and the circumferential walls 11B, 12B separate from the bolt holes BH. In this case, lubricant adhered to the circumferential walls 11B, 12B flows into the suction recesses 60, 61 via the inclined surfaces R.

The lengths of the suction recesses 60, 61 need not be the same.

The compressor need not be a double-headed piston swash plate type compressor, but may be a single-headed piston swash plate type compressor.

The invention claimed is:

1. A swash plate type compressor, comprising:

a housing, which defines a swash plate chamber inside the housing, the swash plate chamber containing refrigerant gas;

a drive shaft rotatably supported by the housing, the drive shaft defining an axial direction, a circumferential direction and a radial direction;

a cylinder block included in the housing, the cylinder block having a shaft bore, through which the drive shaft extends, a plurality of cylinder bores arranged about the shaft bore at intervals from one another, and a plurality of guide passages, the guide passages each connecting the associated cylinder bore to the shaft bore;

a plurality of pistons, each piston of the plurality of pistons being disposed in a corresponding cylinder bore of the plurality of cylinder bores;

a swash plate accommodated in the swash plate chamber, the swash plate including a boss, which is mounted on the drive shaft, and a plate portion, which extends from a circumferential surface of the boss to be inclined with respect to the drive shaft, the plate portion being coupled to the pistons, and the swash plate rotates integrally with the drive shaft causing each piston to reciprocate in the corresponding cylinder bore;

a rotary valve, which rotates in synchronization with the drive shaft, the rotary valve including a suction passage, which sequentially communicates with the cylinder bores in a suction stroke via the associated guide passage; and a plurality of introduction guides, each of which communicates with the shaft bore to introduce the refrigerant gas in the swash plate chamber to the rotary valve, the introduction guides facing the boss and extending in the radial direction from the shaft bore beyond the boss, wherein the suction passage is adapted to include a communication section, which communicates with the introduction guides, wherein each introduction guide is adapted to include an opening end to communicate with the suction passage, the opening end being adapted to face inside along the radial direction, wherein, when the drive shaft is at any rotational position, the communication section is adapted to constantly face at least one of the opening ends, wherein the suction passage includes a first communication section, which corresponds to the introduction guides in the axial direction, and a second communication section, which corresponds to one of the guide passages in the axial direction, and wherein the dimension of the first communication section in the circumferential direction is greater than the dimension of the second communication section in the circumferential direction, the first communication section and the second communication section are formed in the shape of steps, and the cut-out depth of the drive shaft at the suction passage changes stepwise.

2. The compressor according to claim 1, wherein each introduction guide includes an opening section, which is open to the swash plate chamber to face the plate portion, and wherein the area of the opening section open to the swash plate chamber is greater than or equal to the cross-sectional area of the introduction guide perpendicular to the radial direction.

3. The compressor according to claim 1, wherein the cylinder block includes a block body, which includes the introduction guide, and a wall, which extends from the periphery of the block body, and wherein each introduction guide is adjacent to the wall.

4. The compressor according to claim 1, wherein the cylinder block includes:

a block body including the introduction guide;

a wall extending from the periphery of the block body; and an inclined surface located between each introduction guide and the wall.

5. The compressor according to claim 3, wherein the housing includes a housing member joined to the cylinder block, the block body includes a bolt hole located adjacent to the wall, the cylinder block and the housing member being coupled to each other by a through bolt disposed in the bolt hole, and wherein the introduction guide includes part of the bolt hole.

6. The compressor according to claim 1, wherein the introduction guides and the cylinder bores are arranged alternately one by one.

7. The compressor according to claim 1, wherein the cylinder block is one of a pair of cylinder blocks facing each other, wherein the pistons are double-headed pistons, and wherein the communication section constantly faces at least two of the opening ends.

8. The compressor according to claim 1, wherein each introduction guide communicates with an annular groove, which surrounds the shaft bore.

9. The compressor according to claim 1, wherein the suction passage is formed in a circumferential surface of the drive shaft, and the circumferential surface selectively blocks one of the guide passages.

* * * * *